US006364500B1

(12) United States Patent
McCalla et al.

(10) Patent No.: US 6,364,500 B1
(45) **Date of Patent: *Apr. 2, 2002**

(54) LIGHTED HANDLE

(75) Inventors: Gavin McCalla; William R. Lutz, both of Cumming, GA (US)

(73) Assignee: McCalla Company, Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/441,841

(22) Filed: Nov. 17, 1999

Related U.S. Application Data

(63) Continuation of application No. 09/069,549, filed on Apr. 29, 1998, now Pat. No. 6,030,092.

(51) Int. Cl.[7] ..... B25B 23/18
(52) U.S. Cl. ..... 362/120; 362/578; 362/119
(58) Field of Search ..... 362/109, 119, 362/120, 190, 191, 208, 399, 578

(56) References Cited

U.S. PATENT DOCUMENTS

| | | | | |
|---|---|---|---|---|
| 364,694 A | | 11/1887 | Silvia | D26/38 |
| 401,130 A | | 11/1889 | Maier et al. | D8/87 |
| 1,144,210 A | | 6/1915 | Kincaid | |
| 1,253,769 A | * | 1/1918 | Anderson | 362/120 |
| 1,439,404 A | | 12/1922 | Cotharin | 240/6.46 |
| 1,603,985 A | | 10/1926 | Rosenberg | |
| 1,635,933 A | | 7/1927 | Genoves | |
| D118,849 S | | 2/1940 | Zimmer | |
| 2,242,536 A | | 5/1941 | Montgomery | 240/6.46 |
| D130,814 S | | 12/1941 | Comiskey et al. | |
| 2,288,093 A | | 6/1942 | Kaffenberger et al. | 240/6.46 |
| 2,341,375 A | | 2/1944 | Hambleton | 240/6.46 |
| 2,466,342 A | | 1/1949 | Watts | 240/6.46 |
| 2,706,769 A | | 4/1955 | Cook | 240/6.46 |
| 2,736,792 A | | 2/1956 | Freeland | 240/6.46 |
| 2,773,974 A | | 12/1956 | Markett | 240/6.46 |
| 2,783,364 A | | 2/1957 | Wood, Jr. | 240/6.46 |
| D182,397 S | | 4/1958 | Blum | |

(List continued on next page.)

FOREIGN PATENT DOCUMENTS

| | | |
|---|---|---|
| EP | 0 306 461 A1 | 3/1989 |
| EP | 0 421 721 A2 | 10/1991 |
| GB | 2 031 316 | 11/1982 |
| GB | 2 053 438 | 4/1983 |
| GB | 2 272 967 | 6/1996 |

OTHER PUBLICATIONS

Applicants's co–pending Application (U.S. Patent Application Serial No. 09/483,710 filed Jan. 14, 2000.
Applicant's co–pending Application (U.S. Patent Application Serial No. 09/636,366 filed Aug. 11, 2000.
Applicant's co–pending Application (U.S. Patent Application Serial No. 29/127,772 filed Aug. 11, 2000.
Applicant's co–pending Application (U.S. Patent Application Serial No. 29/127,773 filed Aug. 11, 2000.

*Primary Examiner*—Stephen Husar
(74) *Attorney, Agent, or Firm*—Needle & Rosenberg, P.C.

(57) ABSTRACT

A lighted handle including a handle member, which has a distal end adapted to complementarily engage a desired tool and which defines a bore longitudinally extending along at least a portion of its length, and a light module, or flashlight. The light module has a light source capable of producing a beam of light and the light module is of a size to be complementarily received within the bore of the handle member so that the light source illuminates the tool attached to the distal end of the handle member. The light module is detachably secured within the bore of the handle member, such as by complementarily threaded surfaces, so that the light module is insertable into the bore and removable therefrom. Thus, the light module can be either used to illuminate the tool when disposed within the bore of the handle member or used independently as a conventional light module.

5 Claims, 2 Drawing Sheets

U.S. PATENT DOCUMENTS

| | | | | |
|---|---|---|---|---|
| D197,757 | S | 3/1964 | Nagamori | D93/4 |
| 3,185,832 | A | 5/1965 | Nagamori | 240/6.46 |
| 3,603,782 | A | 9/1971 | Wortmann | 240/6.46 |
| 3,919,541 | A | 11/1975 | Chao | 240/6.46 |
| 4,283,757 | A | 8/1981 | Nalbandian et al. | 362/120 |
| D269,850 | S | 7/1983 | Preisler et al. | |
| D274,122 | S | 6/1984 | Stahel et al. | |
| 4,458,300 | A | 7/1984 | Walsh | |
| 4,669,186 | A | 6/1987 | Liu | |
| D295,011 | S | 4/1988 | Herron et al. | |
| 4,768,137 | A | 8/1988 | Hwaw et al. | 362/120 |
| 4,936,171 | A | 6/1990 | Berg | 81/451 |
| D323,448 | S | 1/1992 | Salviato | |
| D323,449 | S | 1/1992 | Corona et al. | D8/83 |
| 5,124,893 | A | 6/1992 | Jeng | 362/120 |
| D327,827 | S | 7/1992 | Kwan | D8/61 |
| D328,699 | S | 8/1992 | Shaanan et al. | D8/82 |
| D329,185 | S | 9/1992 | Hasegawa | |
| D330,497 | S | 10/1992 | Hsin | D8/68 |
| D331,356 | S | 12/1992 | Amsberry | D8/68 |
| D333,239 | S | 2/1993 | Pogue | |
| 5,211,468 | A | 5/1993 | Jeng | 362/120 |
| D340,633 | S | 10/1993 | Badiali | D8/85 |
| 5,265,504 | A | 11/1993 | Fruhm | 81/439 |
| 5,313,376 | A | 5/1994 | McIntosh | |
| 5,369,555 | A | 11/1994 | McKain et al. | 362/120 |
| D358,316 | S | 5/1995 | Markwart et al. | D8/82 |
| D359,789 | S | 6/1995 | Seber et al. | |
| D363,012 | S | 10/1995 | Humphries | D8/87 |
| D364,694 | S | 11/1995 | Silvia | D26/38 |
| 5,473,519 | A | 12/1995 | McCallops et al. | 362/120 |
| 5,510,962 | A | 4/1996 | Hsiao | 362/120 |
| 5,515,249 | A | 5/1996 | Shiao | 362/119 |
| 5,550,719 | A | 8/1996 | Kuo | 362/120 |
| 5,568,698 | A | 10/1996 | Harding et al. | |
| D375,243 | S | 11/1996 | Hasegawa | |
| 5,577,829 | A | 11/1996 | Hall | 362/119 |
| D376,305 | S | 12/1996 | Kung | D8/82 |
| 5,584,565 | A | 12/1996 | Berg | 362/120 |
| 5,628,556 | A | 5/1997 | Hrabar et al. | 362/119 |
| D383,660 | S | 9/1997 | Anderson | D8/83 |
| 5,713,656 | A | 2/1998 | Lin | 362/120 |
| 5,727,319 | A | 3/1998 | Myerchin et al. | |
| D401,130 | S | 11/1998 | Maier et al. | D8/87 |
| D404,277 | S | 1/1999 | Shiao | |
| D408,256 | S | 4/1999 | Maxcy | |
| D412,096 | S | 7/1999 | Kung et al. | |
| D412,355 | S | 7/1999 | Saetherbo | |
| 5,921,654 | A | 7/1999 | Coyle | |
| 417,130 | A | 11/1999 | Hollinger | D8/81 |
| 420,269 | A | 2/2000 | Ben-Moshe | D8/81 |
| 6,030,092 | A * | 2/2000 | McCalla et al. | 362/120 |
| 6,135,608 | A | 10/2000 | Lin | 362/119 |

* cited by examiner

LIGHTED HANDLE

This application is a continuation of, and claims the benefit of, application Ser. No. 09/069,549, filed Apr. 29, 1998, now U.S. Pat. No. 6,030,092, which application is hereby incorporated herein by reference.

BACKGROUND OF THE INVENTION

1. Field of the Invention

The present invention relates to a lighted handle that can be used to illuminate a tool or work piece secured thereto, in which the lighted handle includes a handle member and a light module received within a portion of the handle member and removable therefrom.

2. Background Art

Developments in the art have produced various solutions to the problem of technicians working on equipment and components positioned in poorly-lighted environments. For example, automobile and industrial components are often located inside of unlighted enclosures or in areas that block external background light. This problem is particularly troublesome for industrial equipment that is located next to other components that can easily be damaged or that present a hazard to the technician, such as exposed high-voltage sources.

One prior art solution to this problem is a trouble light, which is a light that is connected to an outlet by an extension cord and that the technician hangs in a position to illuminate the component. One obvious problem with this solution is the requirement that an electrical outlet or other power source be located near the equipment that is to be serviced. Additionally, a trouble light and its extension cord are bulky so technicians do not normally carry them when inspecting and adjusting equipment.

Another solution in the art is the development of tools that generate their own light, instead of using external lighting. The advantage of this approach is that the beam of light generated by the tool is directed at the area where the technician is performing the work. Thus, the lighted tools can be used to manipulate nuts, bolts, screws and other fasteners in the poorly-lighted environments using light produced by the tool itself. One example of this solution is disclosed in U.S. Pat. No. 2,242,536, which issued to Montgomery in 1941. More recent examples of similar tools are disclosed in U.S. Pat. No. 5,577,829 to Hall and U.S. Pat. No. 5,628,556 to Hrabar et al. The lighted tools have been found to be more advantageous than other prior art techniques.

However, many technicians still carry small flashlights in addition to the lighted tools. One reason is that the light generated by the tool is diffused passing though the tool more than passing through the lens of a flashlight and, therefore, the light from the tool is a lower intensity than from the flashlight. Moreover, the tool bit attachments block some of the light produced. In addition, the prior art illuminated tools are bulkier than flashlights because the tools must be able to withstand the stresses generated when the technician uses the tool to manipulate nuts, bolts, screws and other fasteners. Furthermore, the tool attachments increase the size of the tools, which also restricts their maneuverability in tight spaces. Accordingly, a need exists in the art for a tool that has a light source which is removable from the tool and that can be used independently as a flashlight.

SUMMARY OF THE INVENTION

The present invention satisfies this and other needs in the art and comprises a handle member and a light module, or a flashlight, for illuminating a portion of the handle member. The portion of the handle member to which tool attachments are connected is its distal end. The handle member also defines a bore longitudinally extending along at least a portion of the length. A portion of the handle member is optically conductive between the bore and the distal end of the handle member so that light can traverse therethrough.

The light module or other illumination means having a light source is removably inserted into the bore of the handle member. The light module is of a size to be complementarily received within the bore so that the light source is disposed within the bore adjacent the distal end of the handle member. When the light source is energized, the light emitted therefrom illuminates the tool bit attachment or work piece attached to the distal end of the handle member. The light module can also be removed from the bore and used independently of the handle member.

A means for detachably securing the light module within the bore of the handle member allows the light module to be freely inserted into the bore for use of the tool and removed therefrom to be used as a flashlight. The preferred detachably securing means comprises a portion of the light module and a portion of the bore defining complementarily threaded surfaces. This detachably securing means provides a waterproof connection between the handle member and the light module and prevents accidental disengagement of the two components.

The present invention additionally includes a method for illuminating the first end of a work piece or a tool attachment that is longitudinally extending from distal end of the handle member. The method comprises the steps of first detachably inserting a light source into the bore of the handle member and then detachably securing the light source within the bore. The light source is energized to produce a light through the transparent portion of the handle member and onto the work piece.

These and other features of the present invention will become more fully apparent from the following description and accompanying drawings.

DETAILED DESCRIPTION OF THE INVENTION

Figure 1:
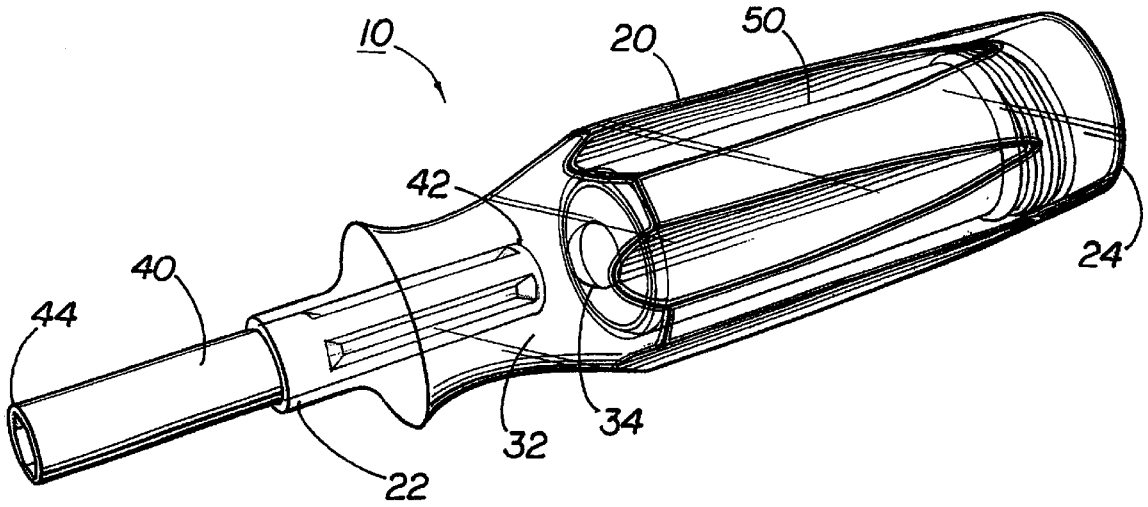
FIG. 1 is a perspective view of a lighted tool handle of the present invention.

The present invention is more particularly described in the following examples that are intended as illustrative only since numerous modifications and variations therein will be apparent to those skilled in the art. As used in the specification and in the claims, "a" can mean one or more, depending upon the context in which it is used. The preferred embodiment is now described with reference to the figures, in which like numbers indicate like parts throughout the figures.

Referring generally to FIGS. 1–7, the present invention encompasses a lighted handle 10 comprising a handle member 20 and a means for illuminating a portion of the handle member 20. The handle member 20 has a distal end 22, a proximal end 24, a longitudinal axis, and a length extending between the proximal and distal ends 22, 24. The handle member 20 also defines a bore 26 longitudinally extending along at least a portion of the length between the proximal and distal ends 22, 24, in which the bore 26 has a first end 28 and an opposite second end 29. The second end 29 is located adjacent the proximal end 24 of the handle member 20. The bore 26 also forms an interior surface 30 of the handle member 20.

A portion of the handle member 20 is optically conductive between the first end 28 of the bore 26 and the distal end 22 so that light can traverse therethrough. In the preferred embodiment, the handle member 20 is a monolithic member that is formed of a clear material, such as a hardened plastic or other similar polymer. Thus, light traverses through the clear plastic that forms the optically conductive portion 32 of the handle member 20. As shown best in FIG. 6, the bore 26 can also include a dome 34 molded into its first end 28 that enhances the propagation of light toward the distal end 22 of the handle member 20. Other materials, such as fiber optics, can be used within the handle member 20 to direct better light through the optically conductive portion 32 of the handle member 20.

A portion of the distal end 22 of the handle member 20 is adapted to complementarily engage one of a plurality of desired tools (not shown), including for example, a screwdriver shaft, socket wrench, and the like. Preferably, the desired tools are each interchangeably mounted to the distal end 22 of the handle member 20 so that the lighted handle 10 can perform multiple functions.

Figure 5:
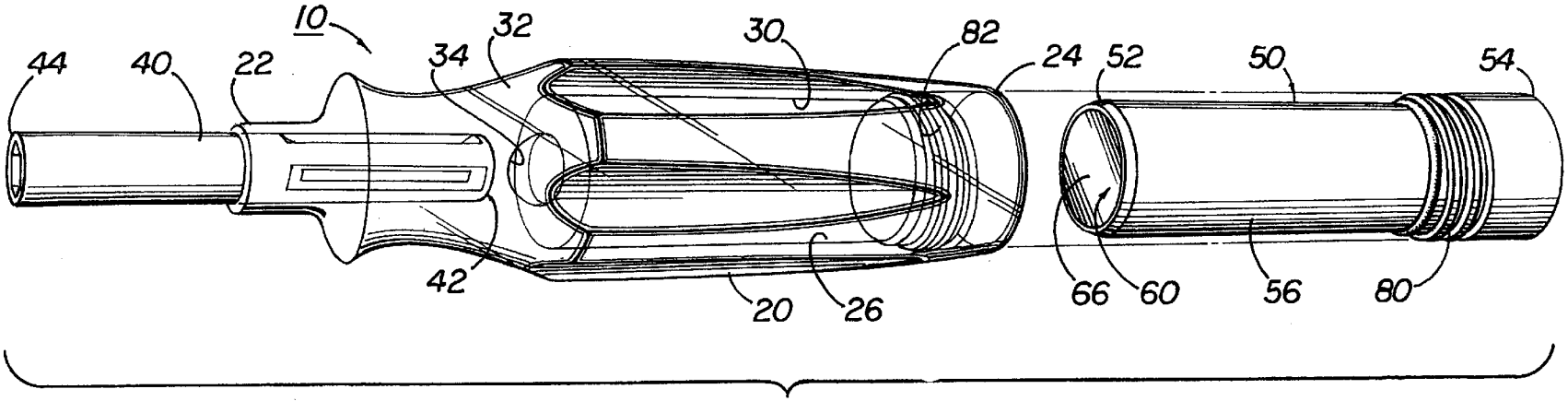
FIG. 5 is an exploded perspective view of FIG. 1.
Figure 6:
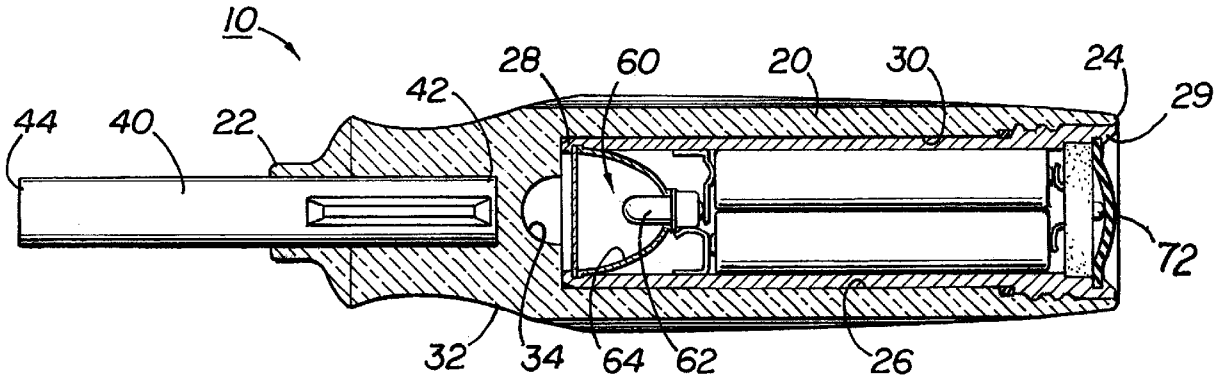
FIG. 6 is a cross-sectional view along line 6—6 in FIG. 3.
Figure 7:
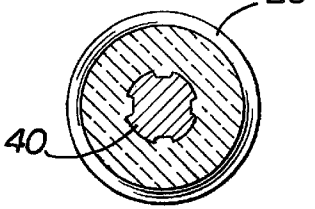
FIG. 7 is a cross-sectional view along line 7—7 in FIG. 2.

The handle member 20 also preferably includes a connecting member 40 fixedly attached to its distal end 22, as shown in FIGS. 1, 2, and 5–7. A rear end 42 of the connecting member 40 is formed into the clear plastic material and grippingly held thereby, which is shown best in FIG. 7. A portion of a forward end 44 of the connecting member 40 is sized to complementarily engage the desired tool. The connecting member 40 is approximately three and one quarter (3¼) inches long in the preferred embodiment, one inch of which is disposed and held within the clear plastic material forming the distal end 22 of the handle member 20. Thus, as shown in FIGS. 6 and 7, the distal end 22 of the handle member 20 securably holds the connecting member 40 so that the connecting member 40 cannot move relative to the handle member 20. Accordingly, the portion of the distal end 22 adapted to complementarily engage the desired tool securably holds the connecting member 40 and the connecting member 40 engages the desired tool so that the connecting member 40 links the distal end 22 of the handle member 20 and the desired tool. In other words, the distal end 22 of the handle member 20 indirectly engages the desired tools via the connecting member 40.

As one skilled in the art will appreciate, the connecting member 40 is not required in the present invention. Instead, the tool can be mounted into the distal end 22 of the handle member 20. That is, the desired tool can be permanently mounted to and grippingly held within the distal end 22 of the handle member 20 (similar to connecting member 40 being fixedly connected to the handle member 20) or the distal end 22 itself defines a slot therein of a size to complementarily and interchangeably engage each desired tool.

Figure 2:
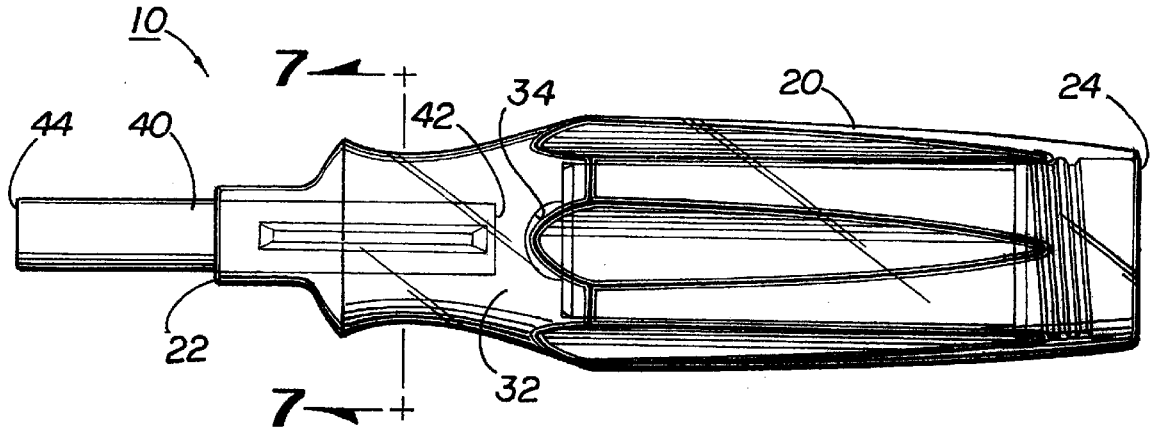
FIG. 2 is a side elevational view of FIG. 1.

Referring now to FIG. 5, the illuminating means in the preferred embodiment comprises a light module 50, or a flashlight, that has a front end 52, an opposed back end 54, and an exterior surface 56. The front end 52 of the light module 50 has a light source 60 capable of producing a beam of light. As shown in FIG. 6, the light module 50 is of a size to be complementarily received within the bore 26 of the handle member 20 so that the front end 52 is disposed adjacent the first end 28 of the bore 26, the back end 54 is disposed adjacent the proximal end 24 of the handle member 20, and the exterior surface 56 is disposed adjacent the interior surface 30 of the handle member 20. As shown in FIGS. 1, 2, and 6, it is preferred that when the light module 50 is disposed within the bore 26 of the handle member 20, the back end 54 of the light module 50 is substantially flush with the proximal end 24 of the handle member 20. Viewing FIG. 5, one skilled in the art will also appreciate that the light module 50, or flashlight, can be used independently of the handle member 20.

The light module 50 preferably has a circular cross-section with an about a one (1) inch diameter and a length of approximately three and a quarter (3¼) inches. The bore 26 has a volume defined by its circular cross-section and its length, in which the volume is of a dimension to complementarily receive the light module 50 therein, e.g., the length of the bore 26 is substantially the same as that of the light module 50 and the cross-section of the bore 26 is slightly larger than the exterior surface 56 of the light module 50. Thus, the light module 50 can be slid into and out of the bore 26. As one skilled in the art will appreciate, the dimensions of the handle member 20 and the light module 50 can be changed, depending on factors such as the anticipated use of the lighted handle 10, manufacturing considerations, and cost.

Another aspect of the light module 50 is a power means for energizing its light source 60. The power means can be any energy source known in the art that can be used to energize a light source, such as chemical energy or electrical energy. The power means comprises removable batteries 70 in the preferred embodiment that are disposed intermediate the front and back ends 52, 54 of the light module 50. When the power means energizes the light source 60, the light module 50 produces the beam of light. The light source 60 and power means can, alternatively, be integral, such as a chemical compound used as both the light source with an inherent power means.

The power means can also comprise a switching means that selectively energizes and de-energizes the light bulb 62. Referring now to FIGS. 2 and 6, the switching means preferably comprises an on-off switch 72 disposed at the back end 54 of the light module 50 that is movable between an on position, in which the switching means is positioned to energize the light bulb 62 using the power means, and an off position, in which the power means does not energize the light bulb 62.

The beam of light produced by the energized light source 60 when the light module 50 is disposed within the bore 26 travels from the front end 52 of the light module 50, through the optically conductive portion 32 of the handle member 20, and out of the distal end 22. Accordingly, the light beam illuminates the desired tool complementarily engaged by the distal end 22 of the handle member 20, allowing the user to see the work area better. As shown in FIGS. 1, 2, and 5, the connecting member 40 is disposed in a position laterally centered relative to the optically conductive portion 32 of the handle member 20 so that the beam of light produced by the light module 50 circumscribes the connecting member 40. That is, the connecting member 40 and attached desired tool are centered relative to the beam of light so that the light beam circumscribes the connecting member 40 and the tool.

Referring now to FIG. 6, the preferred light source 60 comprises a light bulb 62 disposed adjacent the front end 52 of the light module 50 and a reflective shield 64. The light bulb 62 is preferably recessed within the light module 50 adjacent its front end 52. The reflective shield 64 circumscribes at least a portion of the light bulb 62 so that when the power means energizes the light bulb 62 to produce light, the reflective shield 64 reflects a portion of the light to form the light beam, instead of light propagating in all directions. More specifically, the reflective shield 64 directs the light beam away from the back end 54 of the light module 50 and toward the distal end 22 of the handle member 20 when disposed in the bore 26 thereof. The reflective shield 64 is preferably parabolic in cross-section, which maximizes the efficacy of light around the connecting member 40 and the tool. The parabolic reflective shield 64 also directs the maximum intensity of light in the light beam toward and through the distal end 22 of the handle member 20.

As best shown in FIG. 5, the light source 60 of the light module 50 additionally includes a transparent covering 66 that shields the light bulb 62. The transparent covering 66, for example, encloses the reflective shield 64 and the light bulb 62 to prevent moisture from contacting the light bulb 62 when the light module 50 is used independently of the handle member 20 as a flashlight.

A means for detachably securing the light module 50 within the bore 26 of the handle member 20 is preferably used in the present invention. The detachably securing means allows the light module 50 to be insertable into the bore 26 and removable therefrom. As shown best in FIG. 5, the preferred detachably securing means comprises the back end 54 of the light module 50 and the proximal end 24 of the interior surface 30 of the bore 26 defining complementarily threaded surfaces 80, 82. The light module 50 is inserted into the bore 26 of the handle member 20 and then the two components are twisted relative to each other to be detachably connected. This detachably securing means provides a water resistant connection between the handle member 20 and the light module 50, prevents accidental disengagement of the two components, and hinders accidentally changing the position of the on-off switch 72 of the switching means.

Although not shown, the light module can optionally include a ring member pivotally connected to the back end of the light module for assisting removal of the light module from within the bore. The ring member has a first side and is movable between an extended position, in which the first side of the ring member is spaced apart from the back end of the light module, and a contracted position, in which a portion of the first side of the ring member contacts a portion of the back end of the light module. The ring member can be placed in the extended position and to assist in twisting the light module relative to the handle member.

Other contemplated embodiments of the detachably securing means (not shown) includes using snap locks and a quarter-turn engagement between the components. Still another embodiment of the detachable securing means uses two positioning protrusions located adjacent the back end of the light module body that extend slightly above its external surface. The protrusions are movable between a retracted position, in which a top end of the protrusion is substantially aligned and flush with the exterior surface of the light module, and an extended position, in which the top end of the protrusion extends outwardly from the exterior surface of the light module. A biasing means, such as a leaf or other spring, is used to position the protrusions at the normally extended position and to allow movement between the extended and retracted positions. In conjunction, the interior surface of the bore defines an annular groove therein.

As the light module is axially pushed into the bore, the positioning protrusions are pressed inwardly, against the force of the biasing means, as they traverse through the bore. When the light module slides to the forward most position within the bore, the positioning protrusions align with and are received within the annular groove. The positioning protrusions return to their normally extended position when in registry with the groove to secure the light module within the bore.

To remove the light module from within the bore, the ring member is pivotally flipped up to the extended position and then pulled outwardly away from the handle member. As the light module begins to slide out of the bore, the positioning protrusions on the light module retract as they move past the groove and then spring outwardly from the biasing means after passing out of the proximal end of the bore.

In this embodiment of the detachably securing means, the light module also preferably includes an aligning protrusion located between the back end of the light module and the two positioning protrusions. Additionally, the bore defines an axially extending slit that starts at the edge of the bore and ends prior to the position of the annular groove. The aligning protrusion slides along the axially extending slit in the wall of the bore, in which the aligning protrusion prevents the light module from rotating within the bore.

As noted above, the handle member 20 is preferably formed of a clear material, such as a hardened plastic or other similar polymer. One option with this embodiment is to mold graphics (not shown), such as a trademark design, trademark name, or business name, into the handle member 20. This results in the graphics being edge lit by the light source 60 of the light module 50, which is aesthetically appealing.

In another embodiment, the handle member 20 can be partially or substantially formed of an elastomeric material, instead of the clear material discussed above. For example, the plastic handle member 20 can be over-molded so that the elastomeric material covers its surface. Alternatively, the majority of the handle member 20 can be formed of the elastomeric material, with the exception of the optically conductive portion 32 of the handle member 20.

As also noted above, the present invention is preferably adapted to be used with plurality of desired tools, in which each of the desired tools is individually coupled to the distal end 22 of the handle member—either directly or via the connecting member 40. That is, although there are preferably a plurality of tools that can be used with the handle member 20, one tool is used at a time. Addressing the embodiment using the connecting member 40, one tool is selected from the plurality of tools and coupled to the connecting member 40. For example, a first desired tool is attached to the connecting member 40 for one task and then the first desired tool is detached and a second desired tool is coupled to the connecting member 40 for another task. The first tool, for example, can be a screwdriver for screwing a bolt and the second tool can be a socket wrench for twisting a nut.

Figure 3:
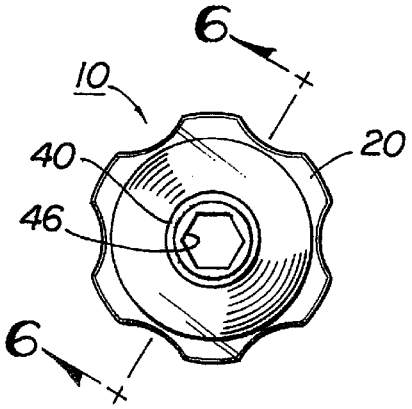
FIG. 3 is a front end view of FIG. 1.
Figure 4:
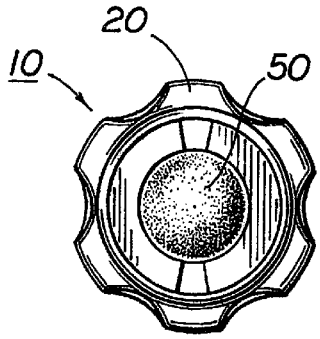
FIG. 4 is a back end view of FIG. 1.

The slot 46 of the connecting member 40 and the mounting end of each of the tools further comprise an interlocking means, in which the surfaces of the slot 46 and the mounting end of the tools engage each other so that the two surfaces interlock. The interlocking means prevents rotational slippage between the connecting member 40 and the tool when used to manipulate a screw or other fastener. Preferably, the two surfaces have a plurality of complementary, longitudinally-extending cuts, wherein the cuts engage with each other. The slot 46 of the preferred embodiment has a hexagonal cross-section as is shown in FIG. 3 and, accordingly, accepts the mounting ends of the tools, which have a corresponding hexagonally-shaped mounting end. Other contemplated interlocking means include threaded connections and other complementarily shaped surfaces.

The hexagonal interlocking means can also comprise the mounting end of the tool having a circular protrusion and the slot 46 of the connecting member 40 defining a indentation therein of a size to receive the circular protrusion. This design, which prevents the tool from inadvertently separating from the connecting member 40, is similar to the design of a conventional socket and socket wrench.

Although the present invention has been described with reference to specific details of certain embodiments thereof, it is not intended that such details should be regarded as limitations upon the scope of the invention except as and to the extent that they are included in the accompanying claims.

What is claimed is:

1. A lighted handle, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member, wherein a portion of the distal end is adapted to complementarily engage a desired tool, and wherein a portion of the handle member is optically conductive between the first end of the bore and the distal end so that light can traverse therethrough;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member;

c. power means for energizing the light source; and d. means for detachably securing the light module within the bore of the handle member so that the light module is insertable into the bore and removable therefrom, wherein, when the light module is disposed within the bore, the beam of light produced by the light source travels from the front end of the light module, through the optically conductive portion of the handle member, and out of the distal end, and wherein the optically conductive portion of the handle comprises a hardened transparent plastic material.

2. A lighted handle, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member, wherein a portion of the handle member is optically conductive between the first end of the bore and the distal end so that light can traverse therethrough;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member;

c. power means for energizing the light source; and d. a connecting member fixedly attached to the handle member adjacent the distal end thereof, a portion of the connecting member sized to complementarily engage a desired tool, wherein, when the light module is disposed within the bore, the beam of light produced travels from the front end of the light module, through the optically conductive portion of the handle member, and out of the distal end to illuminate at least a portion of the connecting member, and wherein the optically conductive portion of the handle comprises a hardened transparent plastic material.

3. A lighted handle, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member, wherein a portion of the distal end is adapted to complementarily engage a desired tool, and wherein a portion of the handle member being optically conductive between the first end of the bore and the distal end so that light can traverse therethrough;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member; and c. power means for energizing the light source, wherein, when the light module is disposed within the bore, the beam of light produced by the light source travels from the front end of the light module, through the optically conductive portion of the handle member, and out of the distal end, and wherein the optically conductive portion of the handle comprises a hardened transparent plastic material.

4. A lighted handle, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member, wherein a portion of the distal end is adapted to complementarily engage a desired tool;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member;

c. power means for energizing the light source; and d. means, disposed between the first end of the bore and the distal end, for optically directing the beam of light produced by the light source of the light module, wherein, when the light module is disposed within the bore, the beam of light travels from the front end of the light module, through the optically directing means, and out of the distal end of the handle member, and wherein the optically directing means comprises a hardened transparent plastic material.

5. A method of illuminating a first end of a work piece that is longitudinally extending from a distal end of a handle member, the handle member having an opposite proximal end and defining a bore extending at least partially therebetween and at least a portion of the distal end being transparent, comprising the steps of:

a. inserting a light source into the bore of the handle member, the light source being operable within the bore as well as externally and independently of the handle member;

b. detachably securing the light source within the bore; and c. energizing the light source so as to produce a light through the transparent portion of the handle member comprising a hardened transparent plastic material and onto the work piece.

* * * * *